US008113104B2

(12) United States Patent
Lucuta et al.

(10) Patent No.: US 8,113,104 B2
(45) Date of Patent: Feb. 14, 2012

(54) CERAMIC COMPONENTS WITH DIAMOND COATING FOR ARMOR APPLICATIONS

(75) Inventors: Vlad Lucuta, Gananoque (CA); Petru Grigorie Lucuta, Gananoque (CA)

(73) Assignee: Aceram Materials and Technologies, Inc., Kingston, Ontario (CA)

( * ) Notice: Subject to any disclaimer, the term of this patent is extended or adjusted under 35 U.S.C. 154(b) by 0 days.

(21) Appl. No.: 11/229,951

(22) Filed: Sep. 19, 2005

(65) Prior Publication Data

US 2007/0234894 A1 Oct. 11, 2007

(30) Foreign Application Priority Data

Sep. 30, 2004 (CA) ..... 2483231

(51) Int. Cl.
*F41H 5/04* (2006.01)

(52) U.S. Cl. ..... 89/36.02; 89/36.05

(58) Field of Classification Search ..... 89/36.02, 89/36.04; 501/90; 109/49.5; 264/642
See application file for complete search history.

(56) References Cited

U.S. PATENT DOCUMENTS

| | | | | | |
|---|---|---|---|---|---|
| 2,566,828 | A | * | 9/1951 | De Laney | 51/308 |
| 4,647,405 | A | * | 3/1987 | Debely | 252/520.22 |
| 4,739,690 | A | | 4/1988 | Moskowitz | |
| 4,757,742 | A | | 7/1988 | Mazelsky | |
| 4,803,182 | A | * | 2/1989 | Ishikawa | 501/94 |
| 4,812,359 | A | | 3/1989 | Hall | |
| 4,836,084 | A | | 6/1989 | Vogelesang et al. | |
| 4,861,666 | A | | 8/1989 | LeGrand et al. | |
| 4,908,083 | A | | 3/1990 | Hall | |
| 4,934,245 | A | | 6/1990 | Musante et al. | |
| 5,017,522 | A | * | 5/1991 | Hegedus | 501/81 |
| 5,032,466 | A | | 7/1991 | Cappa | |
| 5,164,130 | A | * | 11/1992 | Holcombe et al. | 264/432 |
| 5,183,602 | A | * | 2/1993 | Raj et al. | 252/587 |
| 5,218,947 | A | * | 6/1993 | Ajamian | 125/13.02 |
| 5,326,606 | A | | 7/1994 | Labock | |
| 5,361,678 | A | * | 11/1994 | Roopchand et al. | 89/36.02 |
| 5,560,971 | A | | 10/1996 | Emery | |
| 5,733,643 | A | * | 3/1998 | Green | 428/217 |
| 5,905,225 | A | | 5/1999 | Joynt | |
| 6,009,789 | A | | 1/2000 | Lyons | |
| 6,138,275 | A | | 10/2000 | Sacks | |
| 6,332,390 | B1 | | 12/2001 | Lyons | |
| 6,389,594 | B1 | | 5/2002 | Yavin | |
| 6,447,852 | B1 | * | 9/2002 | Gordeev et al. | 427/577 |
| 6,447,916 | B1 | * | 9/2002 | Van Gool | 428/420 |

(Continued)

FOREIGN PATENT DOCUMENTS

DE 28 53 154 A1 8/1980

(Continued)

OTHER PUBLICATIONS

US 6,861,120, 03/2005, Howland (withdrawn)

*Primary Examiner* — Benjamin P Lee
(74) *Attorney, Agent, or Firm* — Carter, DeLuca, Farrell & Schmidt, LLP

(57) ABSTRACT

An improved ceramic armor system comprising a ceramic component and a diamond powder based slurry bonded to a strike surface of the ceramic component, the diamond powder based slurry including a diamond powder and a base selected from the group consisting of a silicate and a phosphate base.

8 Claims, 1 Drawing Sheet

U.S. PATENT DOCUMENTS

| | | | | |
|---|---|---|---|---|
| 6,497,966 | B2 | 12/2002 | Cohen | |
| 6,537,654 | B1 | 3/2003 | Gruber et al. | |
| 6,575,075 | B2 | 6/2003 | Cohen | |
| 6,698,331 | B1 | 3/2004 | Yu et al. | |
| 6,709,736 | B2 | 3/2004 | Gruber et al. | |
| 6,805,034 | B1 | 10/2004 | McCormick et al. | |
| 6,884,384 | B2 * | 4/2005 | Merrill et al. | 264/642 |
| 6,895,851 | B1 | 5/2005 | Adams et al. | |
| 6,911,247 | B2 | 6/2005 | Howland | |
| 6,955,112 | B1 | 10/2005 | Adams et al. | |
| 6,995,103 | B2 | 2/2006 | Aghajanian | |
| 7,128,963 | B2 | 10/2006 | Benitsch | |
| 2002/0178900 | A1 | 12/2002 | Ghiorse et al. | |
| 2003/0080477 | A1 * | 5/2003 | Merrill et al. | 264/637 |
| 2003/0139108 | A1 | 7/2003 | Klintworth et al. | |
| 2003/0151152 | A1 | 8/2003 | Nichelson et al. | |
| 2003/0180517 | A1 | 9/2003 | Karall | |
| 2004/0020353 | A1 | 2/2004 | Ravid et al. | |
| 2004/0028868 | A1 | 2/2004 | James | |
| 2004/0084304 | A1 * | 5/2004 | Thompson | 204/296 |
| 2004/0097360 | A1 | 5/2004 | Benitsch et al. | |
| 2004/0118271 | A1 | 6/2004 | Puckett et al. | |
| 2004/0147191 | A1 | 7/2004 | Wen | |
| 2005/0005762 | A1 | 1/2005 | Lujan | |
| 2005/0072294 | A1 | 4/2005 | Cohen | |
| 2005/0087064 | A1 | 4/2005 | Cohen | |
| 2005/0186104 | A1 * | 8/2005 | Kear et al. | 419/11 |
| 2005/0188831 | A1 | 9/2005 | Squires et al. | |
| 2005/0217471 | A1 | 10/2005 | Benitsch | |
| 2006/0065111 | A1 | 3/2006 | Henry | |

FOREIGN PATENT DOCUMENTS

| | | | |
|---|---|---|---|
| DE | 29 27 653 | A1 | 1/1981 |
| EP | 0 168 746 | | 1/1986 |
| EP | 0 334 263 | B1 | 9/1989 |
| EP | 0620411 | A1 | 10/1994 |
| EP | 0 807 797 | B1 | 11/1997 |
| EP | 0 942 255 | A1 | 9/1999 |
| EP | 0 994 084 | B1 | 4/2000 |
| EP | 0 995 730 | B1 | 4/2000 |
| EP | 1 288 607 | A1 | 3/2003 |
| EP | 1 337 166 | B1 | 8/2003 |
| EP | 1 369 149 | A1 | 12/2003 |
| EP | 1380809 | | 1/2004 |
| EP | 1 522 817 | A1 | 9/2004 |
| EP | 1 521 051 | A1 | 4/2005 |
| EP | 1 637 507 | A2 | 3/2006 |
| EP | 1643207 | | 4/2006 |
| FR | 335605 | | 9/1903 |
| FR | 1041126 | | 10/1953 |
| FR | 2519133 | | 7/1983 |
| GB | 2 156 272 | A | 10/1985 |
| GB | 2 260 600 | A | 4/1993 |
| GB | 2 276 933 | A | 10/1994 |
| GB | 2 276 934 | A | 10/1994 |
| GB | 2 276 934 | B | 10/1994 |
| GB | 2 276 935 | A | 10/1994 |
| GB | 2 277 141 | A | 10/1994 |
| GB | 2 283 902 | A | 5/1995 |
| GB | 2 285 209 | A | 7/1995 |
| GB | 2 287 639 | A | 9/1995 |
| GB | 2 335 388 | A | 9/1999 |
| GB | 2 336 807 | A | 11/1999 |
| GB | 2 377 006 | A | 12/2002 |
| WO | WO 91/07633 | | 5/1991 |
| WO | WO 92/09861 | | 6/1992 |
| WO | WO 97/16697 | | 5/1997 |
| WO | WO 98/44309 | | 10/1998 |
| WO | WO 99/22195 | A1 | 5/1999 |
| WO | WO 00/33015 | A2 | 6/2000 |
| WO | WO 02/41719 | A1 | 5/2002 |
| WO | WO 03/086748 | A1 | 10/2003 |
| WO | WO 2004/109216 | A2 | 12/2004 |
| WO | WO 2005/045351 | A1 | 5/2005 |
| WO | WO 2005/098343 | A1 | 10/2005 |

* cited by examiner

CERAMIC COMPONENTS WITH DIAMOND COATING FOR ARMOR APPLICATIONS

This application corresponds and claims priority to co-pending Canadian Patent Application Ser. No. 2,483,231, filed Sep. 30, 2004. The priority of this prior application is expressly claimed and its disclosure is hereby incorporated by reference in its entirety.

FIELD OF THE INVENTION

The present invention relates to ceramic and ceramic matrix composite armor systems and specifically relates to the increase of hardness of the strike face using a diamond coating on the ceramic component.

Ceramic armor systems require two properties to be effective in their protection against projectiles. A first aspect of ceramic armor is the hardness of the ceramic. Ceramic armor systems are effective protection against armor piercing projectiles as the hardness of the ceramic exceeds that of the metal or steel of the projectiles.

A second consideration is the fracture toughness of the ceramic plate. Fracture toughness is an important characteristic for the ballistic performance of ceramic armor.

Ideally, a ceramic armor system would have a high hardness and a high fracture toughness.

In current applications, the ceramics of principal interest for protection against armor piercing projectiles are boron carbide, silicon carbide and aluminum oxide (alumina). Among these ceramics, boron carbide has the highest hardness, but quite a low fracture toughness.

Alumina is an alternative material that is used. Alumina has a lower hardness than boron carbide but when alloyed with a second phase, creating a ceramic-ceramic phase composite, it can exhibit reasonably high fracture toughness. However, this composite is still less hard than boron carbide.

SUMMARY OF THE INVENTION

The present invention seeks to overcome the deficiencies of the prior art by providing a diamond coating on a ceramic component. Specifically, synthetic diamond dispersed into a silicate or a phosphate based slurry can be used for coating a monolithic armor plate for either personal protection or for tiles for a vehicle protection. This coating can then be heat treated to create a bond with the ceramic component. The diamond-coated ceramic exhibits better performance against armor piercing steel core projectiles than the ceramic component on its own.

The present invention therefore provides an armour plate comprising a ceramic base layer having an inner surface and an outer surface, the outer surface having bonded thereto at least one layer of a composite comprising diamond powder dispersed in a substrate bonded to said outer layer of said ceramic base layer.

The present invention also provides a method of increasing the hardness of a ceramic component comprising the steps of fabricating a diamond powder slurry by mixing a diamond powder with a base, applying the diamond powder slurry onto a strike face of said ceramic component, and hardening diamond powder slurry to form a bond between the diamond powder slurry and the ceramic component.

BRIEF DESCRIPTION OF THE DRAWINGS

The present invention will be better understood with reference to the drawings in which.

DETAILED DESCRIPTION OF THE DRAWINGS

Figure 1:
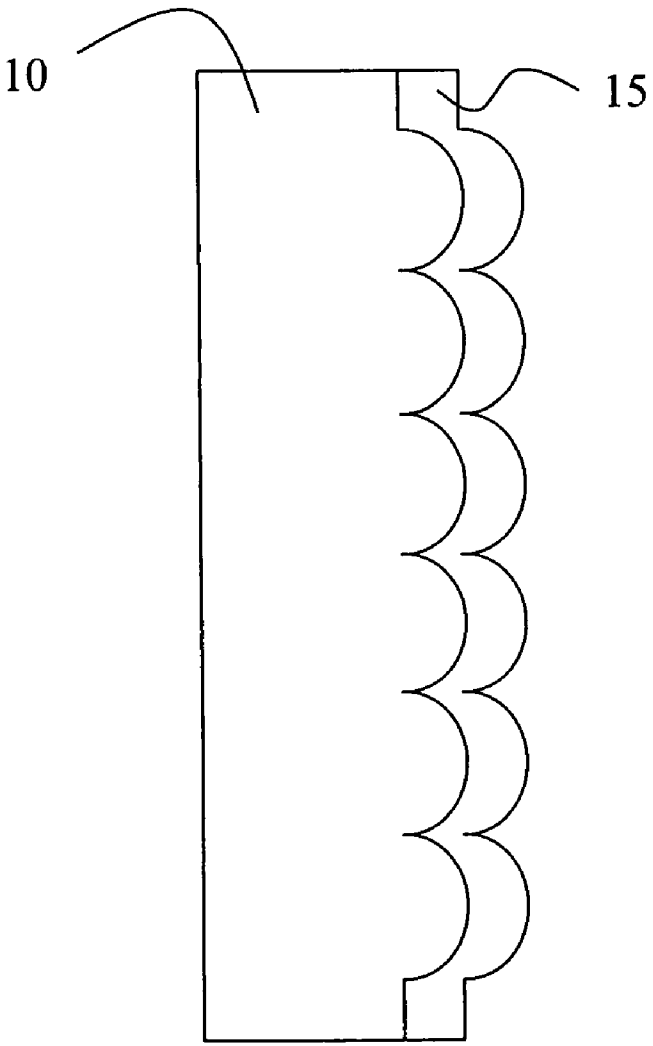
FIG. 1 shows a side cross-sectional view of a ceramic plate coated with the diamond coating of the present invention.

Passive armor has the function of defeating and/or deflecting an impacting projectile. The present invention seeks to provide increased protection against armor piercing projectiles with a steel or other hard core for both vehicle and personal body armor. The present invention may be used for other purposes, as would be appreciated by those skilled in the art, including protection shields and building protection.

In a preferred embodiment of the invention, as illustrated in FIG. 1, a ceramic component 10 is used to defeat an armor piercing projectile. In a preferred embodiment, the ceramic component is composed of aluminum oxide (Alumina), silicon carbide, or a composite made therefrom. These ceramic components have a lower hardness than boron carbide but have an increased fracture toughness.

In order to improve the hardness of these ceramic components, a diamond coating 15 is added over the ceramic component 10. By coating a ceramic component 10 with a diamond coating 15, a higher hardness than boron carbide ceramics is accomplished.

Synthetic diamond, preferably in the 8-15 μm particle size can be used for coating monolithic armor plates for personal protection or tiles for vehicle protection. A diamond powder is dispersed into a hardenable slurry such as a silicate or a phosphate based slurry and in a preferred embodiment is sprayed onto the strike face of a ceramic component. The preferred silicate is calcium silicate, although other silicates such as sodium silicate may be used. As will be appreciated by one skilled in the art, other materials could also be used as long as a chemical adhesive or mechanical bond is achieved between these materials and the ceramic component 10.

Once the ceramic component 10 has been sprayed with the diamond powder and silicate or phosphate slurry mixture, it is then hardened. In the case of most silicate or phosphate compounds, heat-treating at between 300° and 400° F. to form a chemical bond (silicate or phosphate bonding in the preferred embodiment) with the surface of ceramic component 10 is sufficient. However, it will be appreciated that other compounds may be hardened at different temperatures or by other means such as UV. curing or chemical catalysis, as will be apparent to one skilled in the art of laminating materials.

In one embodiment of the present invention, diamond is mixed with a liquid base such as calcium silicate in any proportion suitable for creating a protective diamond layer on ceramic component 10. In a preferred embodiment it has been found that 5 g of diamond powder mixed with 10 g of silicate produces the desired results. However, this is not meant to be limiting.

The above therefore provides a diamond coated ceramic system which exhibits higher ballistic performance against armor piercing steel core projectiles. Through diamond coating, ballistic performance of boron carbide can be achieved in terms of the hardness of the ceramic component while still having the fracture toughness of alumina or silicon carbide based ceramics. Specifically, the inventors have found that a diamond coated ceramic component such as an alumina composite can be harder than a boron carbide plate while having a fracture toughness 6 (six) times greater than boron carbide.

It will be appreciated that multiple layers of coating may be applied, and that additional coatings or layers of other materials such antispall coatings, or UV protective coatings, may be applied over the diamond layer.

The above described embodiments are meant to be illustrative of preferred embodiments and are not intended to limit the scope of the present application. Also, various modifications, which would be readily apparent to one skilled in the art, are intended to be within the scope of the present application. The only limitations to the scope of the present application are set forth in the following claims.

We claim:

1. A ceramic armor system comprising:

a ceramic armor plate including a ceramic base layer having an inner surface and an outer surface, the ceramic base layer selected from the group consisting of monolithic armor plates and tiles, the ceramic base layer wholly comprising ceramic materials and having a uniform composition and wholly comprising ceramic materials and having an inner surface and an outer surface, the outer surface defining a strike face for engaging a ballistic threat;

a layer disposed on the strike face, the layer including a diamond powder suspended in a mixture and bonded to the strike face and such that the ballistic threat engages the layer on the strike face prior to engaging the ceramic base layer, the layer increasing a hardness of the strike face thereby reducing the ballistic threat.

2. The armor system of claim 1, wherein the diamond powder comprises synthetic diamonds with a particle size in the range of 8-15μm.

3. The armor system of claim 1, wherein the layer disposed on the strike face is formed from a diamond powder slurry that is bonded to said outer surface of said ceramic base layer using heat treatment.

4. The armor system of claim 3, wherein the heat treatment is performed between 300° and 400° F.

5. The armor system of claim 1, wherein the ceramic base layer is selected from the group consisting of silicon carbide and aluminum oxide.

6. The armor system of claim 1, wherein the mixture is selected from the group consisting of a silicate and a phosphate.

7. The armor system of claim 6, wherein the diamond powder comprises synthetic diamonds with a particle size in the range of 8-15μmm.

8. The armor system of claim 1, wherein the ceramic base layer is formed from a single ceramic material.

* * * * *